US009997865B2

(12) United States Patent
Yao

(10) Patent No.: US 9,997,865 B2
(45) Date of Patent: Jun. 12, 2018

(54) ELECTRICAL CONNECTOR AND METHOD OF MAKING THE SAME

(71) Applicant: FOXCONN INTERCONNECT TECHNOLOGY LIMITED, Grand Cayman (KY)

(72) Inventor: Tao Yao, Huaian (CN)

(73) Assignee: FOXCONN INTERNCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/599,880

(22) Filed: May 19, 2017

(65) Prior Publication Data

US 2017/0338584 A1 Nov. 23, 2017

(30) Foreign Application Priority Data

May 20, 2016 (CN) ..... 2016 1 0336121

(51) Int. Cl.

| | |
|---|---|
| ***H01R 9/03*** | (2006.01) |
| ***H01R 13/52*** | (2006.01) |
| ***H01R 4/28*** | (2006.01) |
| ***H01R 13/426*** | (2006.01) |
| ***H01R 13/6585*** | (2011.01) |
| ***H01R 43/00*** | (2006.01) |
| *H01R 24/60* | (2011.01) |

(52) U.S. Cl.

CPC ..... *H01R 13/5202* (2013.01); *H01R 4/28* (2013.01); *H01R 13/426* (2013.01); *H01R 13/6585* (2013.01); *H01R 43/005* (2013.01); *H01R 24/60* (2013.01)

(58) Field of Classification Search

CPC .... H01R 13/5202; H01R 4/28; H01R 13/426; H01R 13/6585; H01R 43/005; H01R 24/60

USPC ..... 439/607.41

See application file for complete search history.

(56) References Cited

U.S. PATENT DOCUMENTS

| | | | | |
|---|---|---|---|---|
| 9,391,391 | B2 * | 7/2016 | Chien | H01R 13/5202 |
| 2013/0065442 | A1 * | 3/2013 | Nagata | H01R 13/5202 439/607.58 |
| 2013/0183844 | A1 * | 7/2013 | Wang | H01R 24/68 439/271 |
| 2016/0164218 | A1 * | 6/2016 | Lee | H01R 13/5202 439/587 |

FOREIGN PATENT DOCUMENTS

| | | |
|---|---|---|
| CN | 204538336 | 8/2015 |
| CN | 205016762 | 2/2016 |

* cited by examiner

*Primary Examiner* — Abdullah Riyami
*Assistant Examiner* — Nader Alhawamdeh
(74) *Attorney, Agent, or Firm* — Wei Te Chung; Ming Chieh Chang

(57) ABSTRACT

An electrical connector includes: a plug connector including an insulative housing, plural conductive terminals affixed to the insulative housing, a shielding plate affixed to the insulative housing, and a shielding shell enclosing the insulative housing; and an insulative shell attached to the plug connector and a silicon o-ring integrated with an opening of the insulative shell.

10 Claims, 10 Drawing Sheets

ELECTRICAL CONNECTOR AND METHOD OF MAKING THE SAME

BACKGROUND OF THE DISCLOSURE

1. Field of the Disclosure

The present disclosure relates to a waterproof electrical connector and a method of its manufacturing by integrating a silicon o-ring.

2. Description of Related Arts

China Patent No. 205016762 discloses an electrical connector including an insulative housing, a number of conductive terminals affixed to the insulative housing, a metal shell enclosing the insulative housing, an outer shell enclosing the metal shell and having a recess, and a sealer attached to the recess. The sealer is flexible. One of an outer surface of the recess and an inner surface of the sealer has an adhesive attaching the recess and the sealer attached. However, the adhesive may lose effectiveness after repeated use and affect the waterproof function.

An improved electrical connector is desired.

SUMMARY OF THE DISCLOSURE

Accordingly, an object of the present disclosure is to provide an electrical connector ensuring the waterproof of the electrical connector.

To achieve the above object, an electrical connector comprises: a plug connector including an insulative housing, a plurality of conductive terminals affixed to the insulative housing, a shielding plate affixed to the insulative housing, and a shielding shell enclosing the insulative housing; and an insulative shell attached to the plug connector and a silicon o-ring integrated with an opening of the insulative shell.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
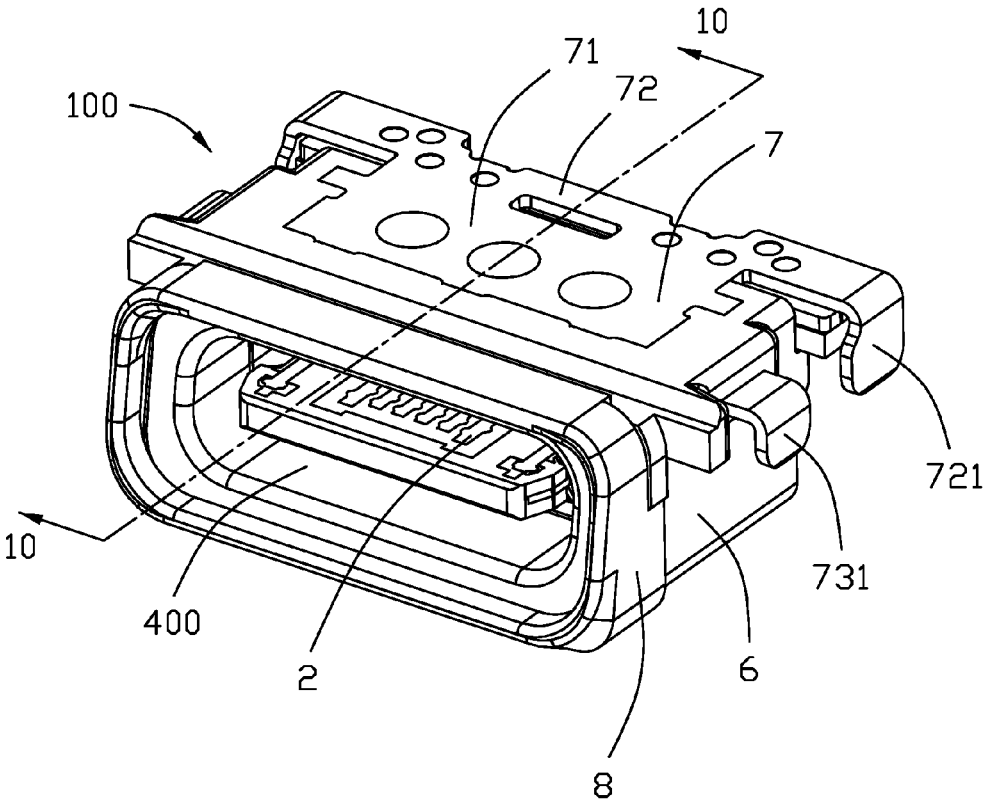
FIG. 1 is a perspective, assembled view of an electrical connector.
Figure 2:
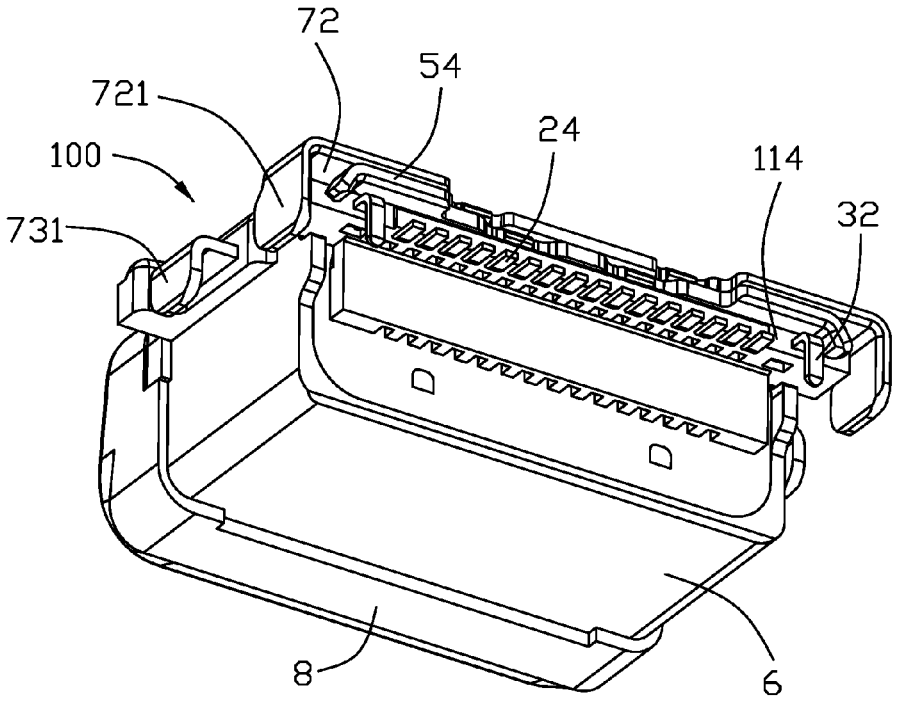
FIG. 2 is another perspective, assembled view of the electrical connector taken from FIG. 1.
Figure 3:
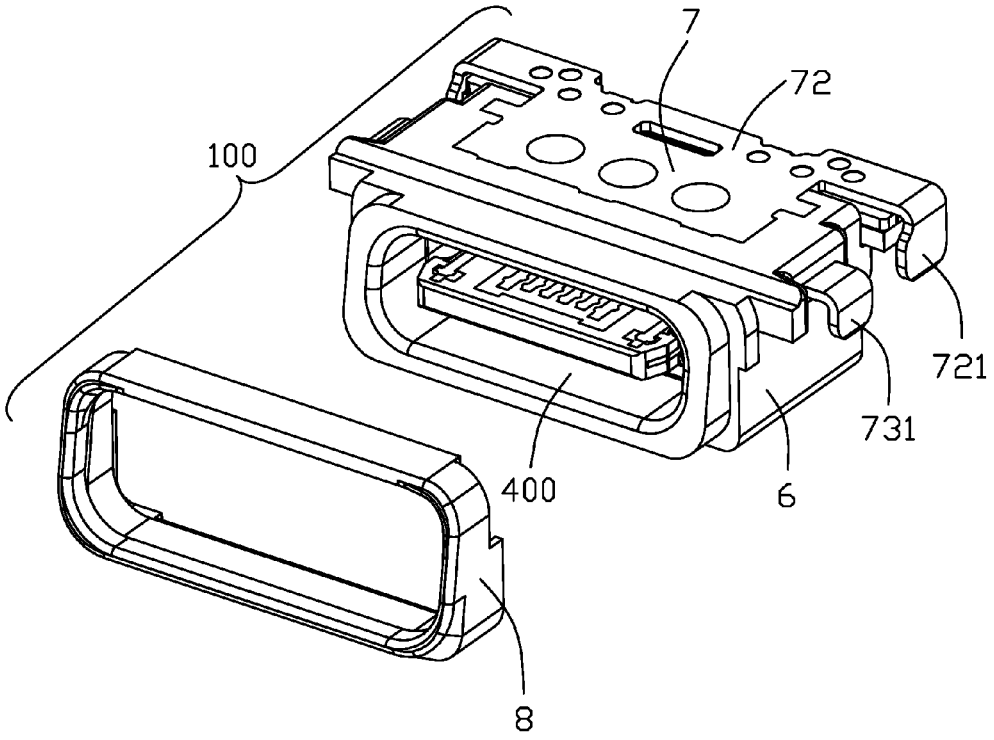
FIG. 3 is a partial exploded view of the electrical connector.
Figure 4:
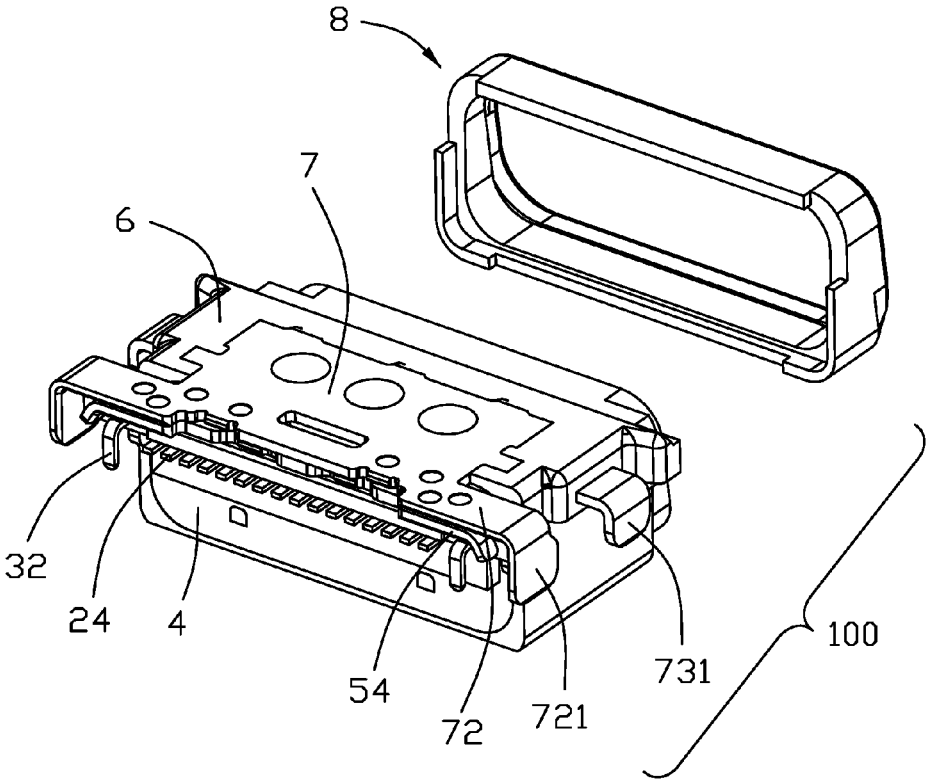
FIG. 4 is another perspective, exploded view of the electrical connector taken from FIG. 3.

Reference will now be made in detail to the first and second embodiments of the present disclosure.

Referring to FIGS. 1 to 10, the electrical connector 100 includes a plug connector 200, an insulative shell 6, an outer metal shell 7 integrated with the insulative shell 6, a silicon o-ring 8 attached to an opening of the insulative shell 6 and a rubber plate 4. The plug connector 200 includes an insulative housing 1, a number of conductive terminals 2 affixed to the insulative housing 1, a shielding plate 3 affixed to the insulative housing 1 and a shielding shell 5 enclosing the insulative shell 1.

Figure 7:
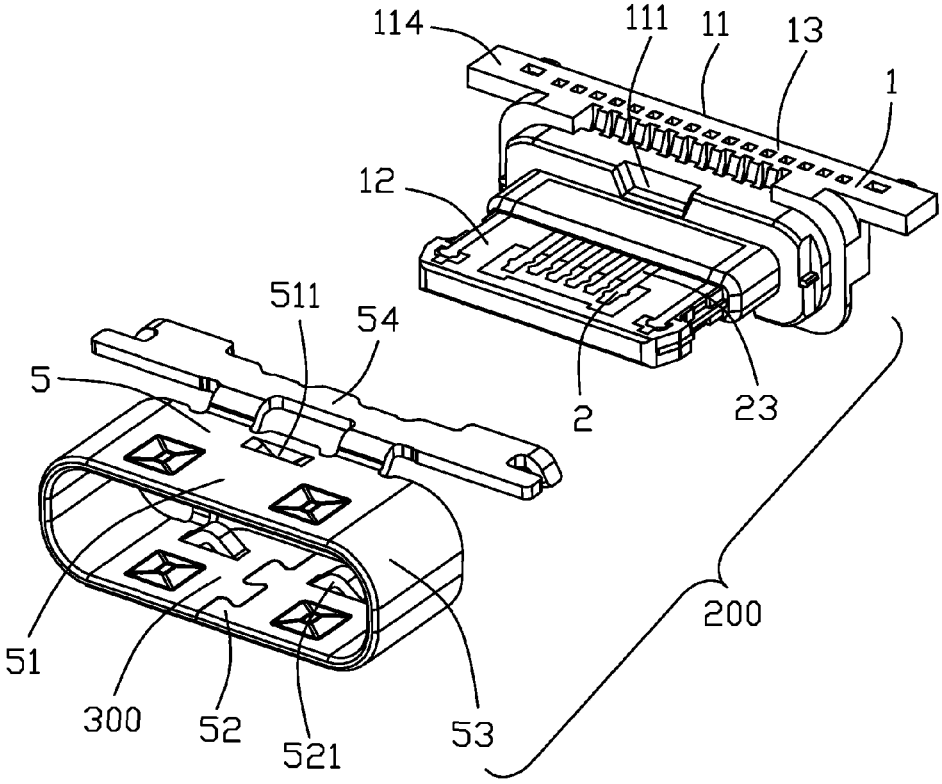
FIG. 7 is a partial perspective, exploded view of a plug connector of the electrical connector.
Figure 8:
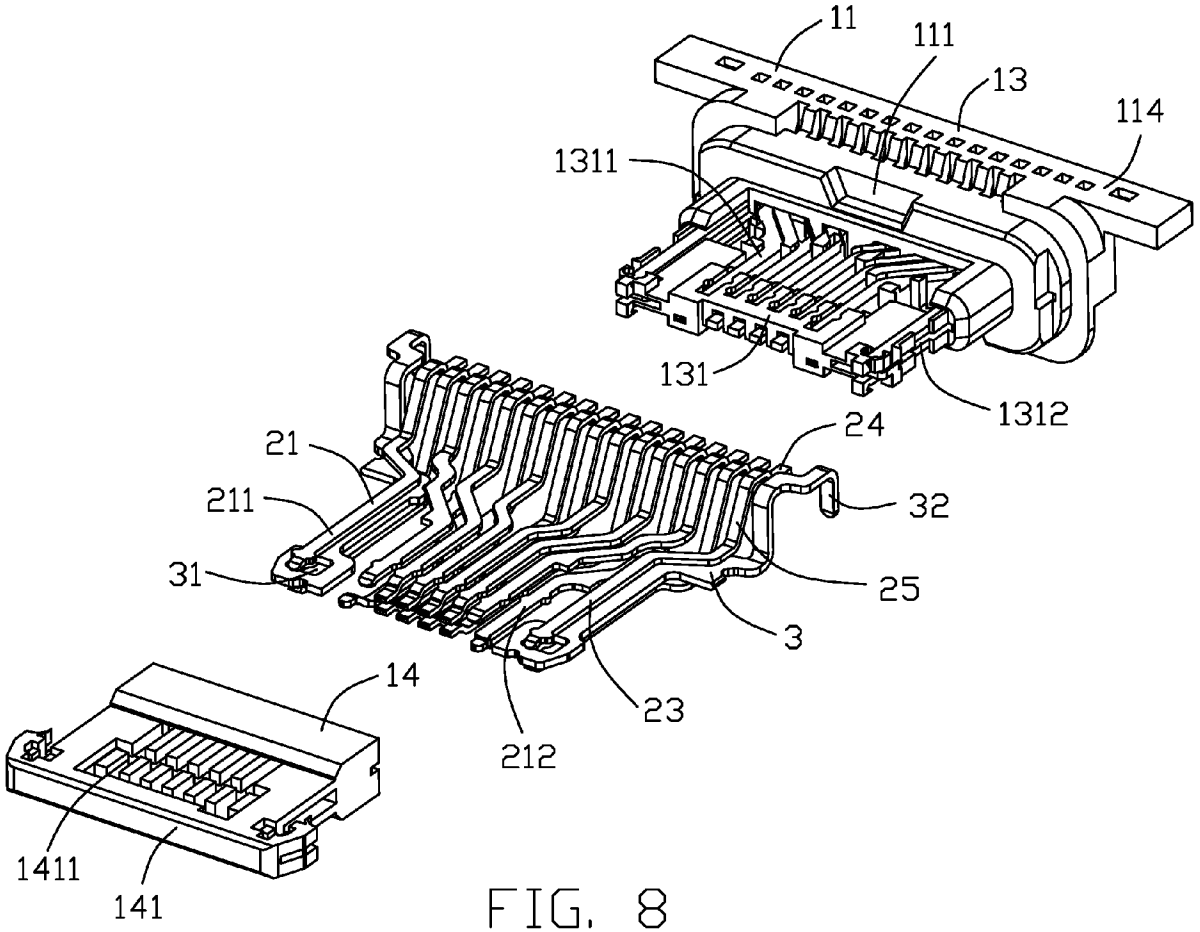
FIG. 8 is a perspective, exploded view of an insulative housing, a number of conductive terminals and a shielding plate.
Figure 9:
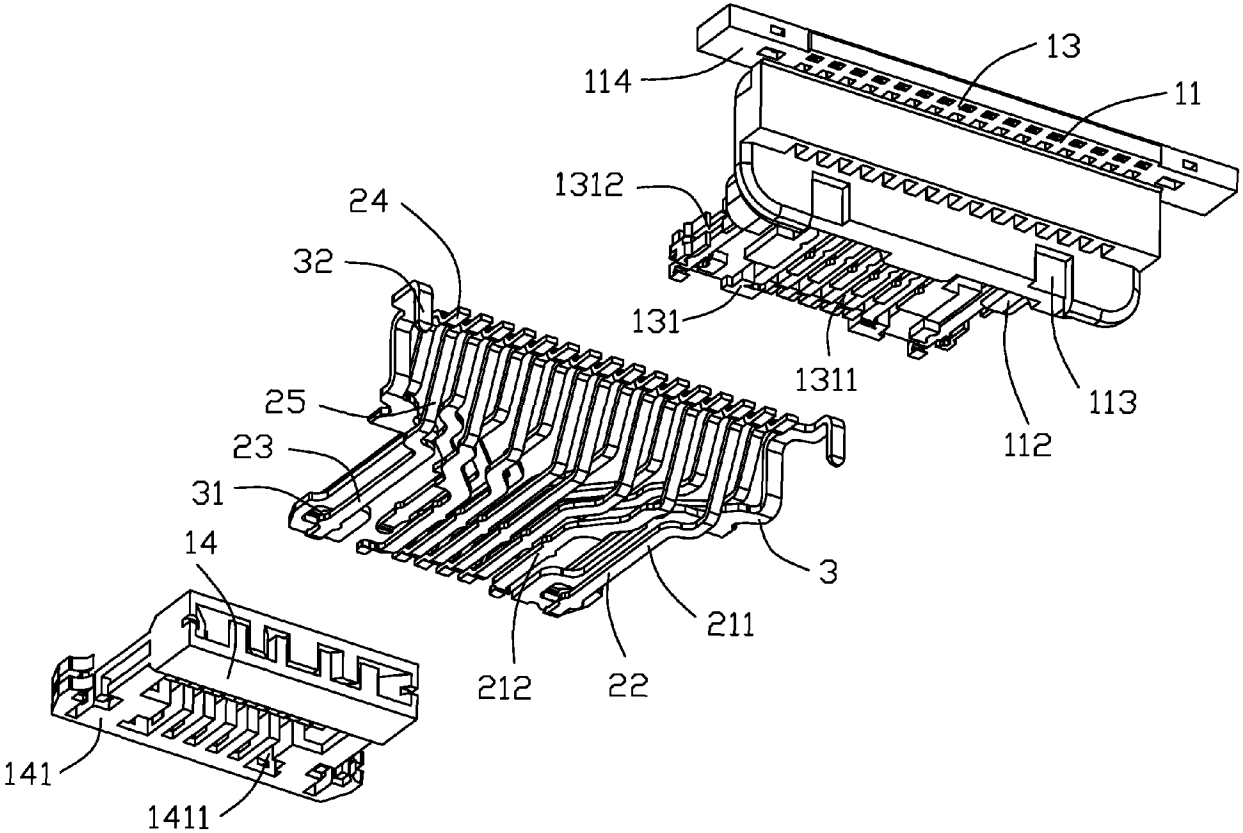
FIG. 9 is another exploded view of the electrical connector taken from FIG. 8.
Figure 10:
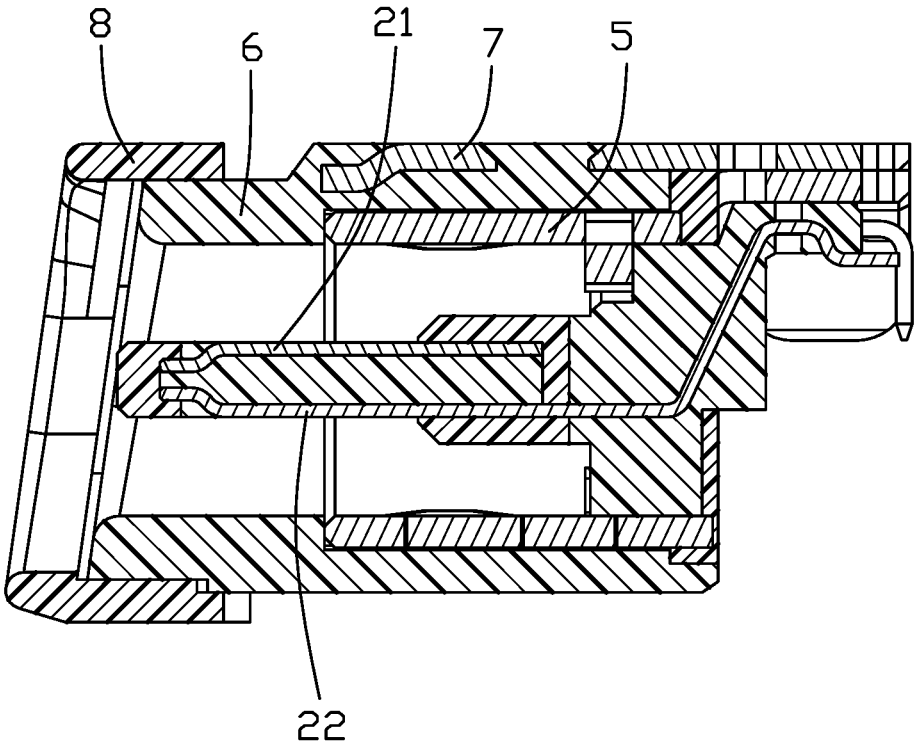
FIG. 10 is a cross-sectional view of the electrical connector taken along line 10-10 in FIG. 1.

Referring to FIGS. 7 to 9, the insulative housing 1 includes a base portion 11 and a tongue portion 12 extending forwardly from the base portion 11. The insulative housing 11 further includes a first insulator 13 and a second insulator 14. The first insulator 13 includes the base portion 11 and a first tongue portion 131 extending forwardly from the base portion 11. The base portion 11 includes a first recess 111 located on an upper surface of the base portion 11 and sunken inwardly, a second recess 112 located at a front end of a lower surface of the base portion 11, a third recess 113 located at a rear end of the lower surface of the base portion 11, and a first flat portion 114 located at the rear end of the base portion 11. The first tongue portion 131 includes a number of terminal accommodating slots 1311 located at an upper surface and a lower surface of the first tongue portion 131 and a number of lateral receiving grooves 1312 located at two sides of the first tongue portion 131. The second insulator 14 includes a second tongue portion 141 having a hollow section 1411.

The conductive terminals 2 include a number of upper terminals 21 and the same number of lower terminals 22. Each of the upper terminals 21 is associated with a respective one of the lower terminals 22 and is positioned in reverse symmetry with respect to the lower terminals 22. The upper terminals 21 and each lower terminals 22 include a pair of outside terminals 211 arranged laterally and six inner terminals 212 located between the outside terminals 211. Each conductive terminal 2 includes a contacting portion 23, a soldering portion 24 and a connecting portion 25 connecting the contacting portion 23 and the soldering portion 24.

The metal sheet 3 is provided with a pair of sheet-like structure separated from each other. The metal sheet 3 includes a gap 31 and a ground pin 32.

Figure 5:
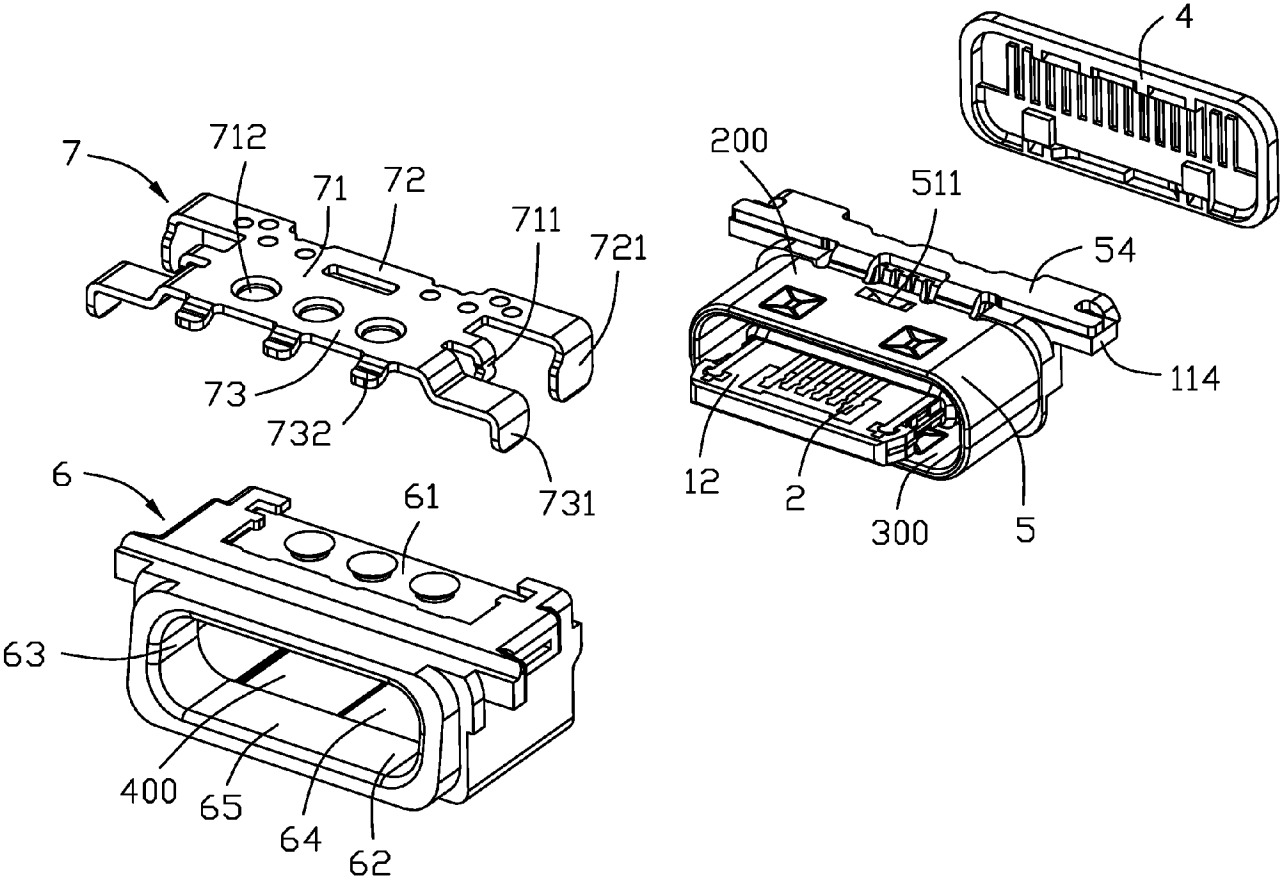
FIG. 5 is a perspective, exploded view of the electrical connector removing a silicon o-ring.
Figure 6:
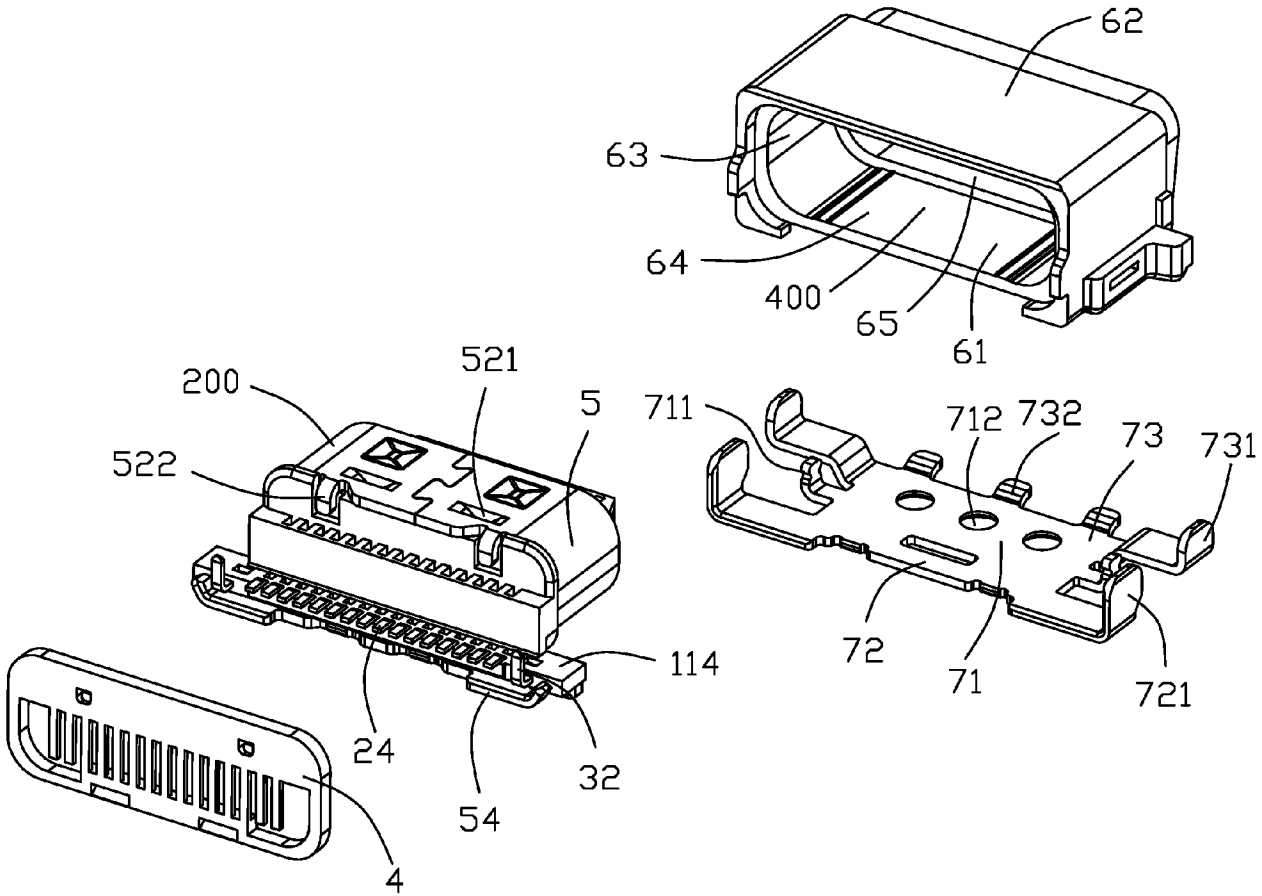
FIG. 6 is another exploded view of the electrical connector taken from FIG. 5.

Referring to FIGS. 5 to 7, the shielding shell 5 includes a top wall 51, a bottom wall 52 opposite to the top wall 51, and a pair of lateral walls 53 connecting the top wall 51 and a bottom wall 52 for forming a receiving room 300. The shielding shell 5 further includes a second flat portion 54 connecting to a rear end of the top wall 51. The top wall 51 includes a resisting portion 511. The bottom wall 52 includes a pair of buckling portions 522 located in a rear end of the bottom wall 52 and a pair of tuber portions 521 located in front of the buckling portions 522 and protruding into the receiving room 300.

Referring to FIGS. 5 to 6, the insulative shell 6 includes a upper plate 61, a lower plate 62 opposite to the upper plate 61, and a pair of lateral plates 63 connecting the upper plate 61 and the lower plate 62 for forming a mating room 400. The insulative shell 6 further includes a first tubular portion 64 in the mating room 400 and a second tubular portion 65 located in front of the first tubular portion 64 and protruding into the mating room 400.

The outer metal shell 7 includes a main portion 71, a third flat portion 72 located in a rear end of the main portion 51 and extending laterally from the main portion 71, a forth flat portion 73 located in a front end of the main portion 51 and extending laterally from the main portion 71. The outer metal shell 7 further includes a pair of first fixing pins 721 bending downwardly from lateral sides of the third flat portion 72, a pair of second fixing pins 711 bending downwardly from lateral sides of the main portion 71, a pair of third fixing pins 731 bending downwardly from lateral sides of the forth flat portion 73, a number of through holes 712 penetrating a top surface and a bottom surface of main portion 71, and a number of fixing plates 732 extending from a front end of the forth flat portion 73.

The method of making the electrical connector 100 includes five steps. In the first step: providing the insulative housing 1 affixing with the conductive terminals 2 and the shielding plate 3 and the shielding shell 5 enclosing the insulative shell for forming the plug connector 200. The second flat portion 54 of the shielding shell 5 resists the first flat portion 114 of the insulative housing 1. Referring to FIGS. 7 to 9, the conductive terminals 2 and the shielding plate 3 are insert molded with the first insulator 13. The contacting portions 23 are received in the terminal accommodating slots 1311 of the first tongue portion 131. The connecting portions 25 are embedded in the base portion 11. The soldering portions 24 extend outwardly from the rear end of the first insulator 13. The soldering portions 24 are in the same plane. The shielding plate 3 is received in the lateral receiving groove 1312. The ground pins 32 extend outwardly from the first insulator 13. Insert molding the first tongue portion 131 with plastic materials to form the insulative housing 1 including the second insulator 14. The contacting portions 23 are exposed to the upper and lower surface of the insulative housing 1. The shielding shell 5 covers the insulative housing 1 to form the plug connector 200. The resisting portion 511 resists the first recess 111. The tuber portion 521 resists the second recess 112. The buckling portion 522 abuts the third recess 113.

In the second step: providing the insulative shell 6 and the outer metal shell 7 insert-molded with the insulative shell 6 to be an integrated part. The first fixing pins 721 are located behind the insulative shell 6. The third fixing pins 731 extend laterally from the insulative shell 6. The liquid silicon is insert molded on an opening of the integrated part to form a silicon o-ring 8.

In the third step: inserting the plug connector 200 into the mating room 400 of the insulative shell 6 along a rear-to-front direction. The shielding shell 5 resists the rear surface of the second tubular portion 65. The third flat portion 72 resists the upper surface of the second flat portion 54.

In the forth step: spot welding the third flat portion 72 and the second flat portion 54 to be an integrated.

In the fifth step: pouring glue from the rear end of the plug connector 200 into the mating room 400 to form the rubber plate 4.

Compared with prior arts, the electrical connector 100 has better effects as follows. The electrical connector 100 comprises the insulative shell 6 enclosing the plug connector 200 and the outer metal shell 7 integrated with the insulative shell 6 for enhancing stiffness and strength of the electrical connector 100. The silicon o-ring is insert-molded with the insulative shell 6 making a good effect of waterproof between the electrical connector 100 and other electrical device.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a plug connector including an insulative housing, a plurality of conductive terminals affixed to the insulative housing, a shielding plate affixed to the insulative housing, and a shielding shell enclosing the insulative housing; and an insulative shell attached to the plug connector and a silicon o-ring integrated with an opening of the insulative shell; wherein the insulative shell has a receiving room, a first tubular portion received in the receiving room, and a second tubular portion located in front of the first tubular portion and protruding from an inner surface of the receiving room, and the shielding shell resists against a rear surface of the first tubular portion.

2. The electrical connector as claimed in claim 1, wherein the insulative housing comprises a base portion having a first recess located on an upper surface thereof, a second recess located in a front end of a lower surface thereof, and a third recess located in a rear end of the lower surface, the shielding shell comprises a top wall having a resisting portion and an opposite bottom wall having a buckling portion located in a rear end thereof and a tuber portion located in front of the buckling portion, the resisting portion resists the first recess, the tuber portion resists the second recess, and the buckling portion abuts against the third recess.

3. The electrical connector as claimed in claim 1, further comprising an outer metal shell insert-molded with the insulative shell.

4. The electrical connector as claimed in claim 3, wherein the insulative housing comprises a first flat portion at a rear end thereof, the shielding shell comprises a second flat portion at a rear end thereof, and the second flat portion resists the first flat portion.

5. The electrical connector as claimed in claim 4, wherein the outer metal shell comprises a main portion and a third flat portion located in a rear end of the main portion and extending outwardly from the main portion, and the third flat portion resists the second flat portion and connects with the second flat portion by spot welding.

6. An electrical connector comprising:

a plug connector including an insulative housing, a plurality of conductive terminals affixed to the insulative housing, a shielding plate embedded within the insulative housing, and a metallic shielding shell enclosing the insulative housing and defining an mating opening extending along a front-to-back direction; and an insulative shell integrally formed with a metallic outer shell via an insert molding process; wherein a silicon o-ring is integrated with the insulative shell around a front opening of the insulative shell via another insert molding process which is done after the insulative shell is integrally formed with the metallic outer shell while before the metallic outer shell is soldered to the shielding shell;

the insulative shell extends forwardly beyond the shielding shell while the silicon o-ring extends forwardly beyond the insulative shell;

the insulative shell defines a first oblique mating face, and the silicon o-ring defines a second oblique mating face in compliance with said first oblique mating face; and an upper part of the silicon o-ring is smaller than a lower part of the silicon o-ring along said front-to-back direction.

7. The electrical connector as claimed in claim 6, wherein the insulative shell extends forwardly beyond the outer shell.

8. An electrical connector comprising:

a plug connector including an insulative housing, a plurality of conductive terminals affixed to the insulative housing, a shielding plate affixed to the insulative housing, and a shielding shell enclosing the insulative housing;

an insulative shell attached to the plug connector and a silicon o-ring integrated with an opening of the insulative shell; and an outer metal shell insert-molded with the insulative shell; wherein the insulative housing comprises a first flat portion at a rear end thereof, the shielding shell comprises a second flat portion at a rear end thereof, and the second flat portion resists the first flat portion; and the outer metal shell comprises a main portion and a third flat portion located in a rear end of the main portion and extending outwardly from the main portion, and the third flat portion resists the second flat portion and connects with the second flat portion by spot welding.

9. The electrical connector as claimed in claim 8, wherein the insulative shell has a receiving room, a first tubular portion received in the receiving room, and a second tubular portion located in front of the first tubular portion and protruding from an inner surface of the receiving room, and the shielding shell resists against a rear surface of the first tubular portion.

10. The electrical connector as claimed in claim 8, wherein the insulative housing comprises a base portion having a first recess located on an upper surface thereof, a second recess located in a front end of a lower surface thereof, and a third recess located in a rear end of the lower surface, the shielding shell comprises a top wall having a resisting portion and an opposite bottom wall having a buckling portion located in a rear end thereof and a tuber portion located in front of the buckling portion, the resisting portion resists the first recess, the tuber portion resists the second recess, and the buckling portion abuts against the third recess.

* * * * *